US006044832A

United States Patent [19]

Piersons, Jr.

[11] Patent Number: 6,044,832

[45] Date of Patent: Apr. 4, 2000

[54] FALL AWAY ARROW REST ASSEMBLY

[76] Inventor: Donald W. Piersons, Jr., 113 Grace Blvd., Painted Post, N.Y. 14870

[21] Appl. No.: 09/131,516

[22] Filed: Aug. 10, 1998

[51] Int. Cl.[7] ..... F41B 5/22

[52] U.S. Cl. ..... 124/44.5

[58] Field of Search ..... 124/24.1, 25.6, 124/44.5

[56] References Cited

U.S. PATENT DOCUMENTS

| | | | |
|---|---|---|---|
| 2,975,780 | 3/1961 | Fisher | 124/44.5 X |
| 3,504,659 | 4/1970 | Babington . | |
| 4,038,960 | 8/1977 | Ludwig . | |
| 4,071,014 | 1/1978 | Trotter . | |
| 4,287,868 | 9/1981 | Schiff . | |
| 4,407,261 | 10/1983 | Elliott . | |
| 4,458,528 | 7/1984 | Eckert . | |
| 4,683,439 | 7/1987 | Cosentino, Jr. . | |
| 4,803,971 | 2/1989 | Fletcher . | |
| 5,161,514 | 11/1992 | Cary | 124/24.1 |
| 5,365,912 | 11/1994 | Pittman | 124/44.5 |
| 5,394,858 | 3/1995 | Karolian | 124/44.5 |
| 5,415,154 | 5/1995 | Angeloni | 124/44.5 |
| 5,490,492 | 2/1996 | Savage | 124/44.5 |
| 5,632,263 | 5/1997 | Sartain | 124/44.5 |
| 5,671,121 | 9/1997 | Bizier | 124/44.5 |

OTHER PUBLICATIONS

"Targetmaster Dual Wire" arrow rest, shown on p. 9 of 1992 Golden Key Futura Catalog.

"Fall–A–Way" arrow rest, shown on p. 25 of 1992 Martin Archery catalog.

*Primary Examiner*—John A. Ricci

*Attorney, Agent, or Firm*—Clinton S. Janes, Jr.

[57] ABSTRACT

An arrow rest assembly for use with a compound bow. The assembly comprises a bracket subassembly mounted to the frame of the bow or to an overdraw assembly, if the bow is optionally equipped therewith; a cable slide slidably mounted on the cable guide bar of the bow and attached to the tuning cables of the bow; a spring loaded arrow rest subassembly rotatable about an axis synchronously with the movement of the tuning cables as the bow string is drawn and released, the subassembly being pivotally mounted to the bracket assembly and carrying an arrow holder guide; and an actuator cord attached to the arrow rest assembly and downwardly acting tuning cable. When the bow is in the relaxed state, the arrow rest subassembly and the actuator cord are in a relaxed position wherein the actuator cord is slack and the arrow rest subassembly acts to keep the arrow from falling off the bow riser of the bow or the shelf of an overdraw assembly, if optionally present. As the bow is drawn, the cable slide moves along the cable guide bar causing the tuning cables to move laterally away from the frame and the actuator cord to lose its slack. Upon becoming taut, the actuator cord overcomes the tension in the spring in the arrow rest subassembly when the bow string is within about 2–4 inches of full draw position, and thereby rotates the holder/guide upward to lift and align the arrow for firing. When the bow string is released from the full draw position, the forward lateral movement of the cable slide and the tuning cables on the cable guide bar, in conjunction with the reverse movement of the formerly downwardly acting tuning cable, allows the cord to go slack. That action permits the spring in the arrow rest subassembly to function, thereby causing the holder/guide of the arrow rest subassembly to rapidly fall away from contact with the arrow.

3 Claims, 4 Drawing Sheets

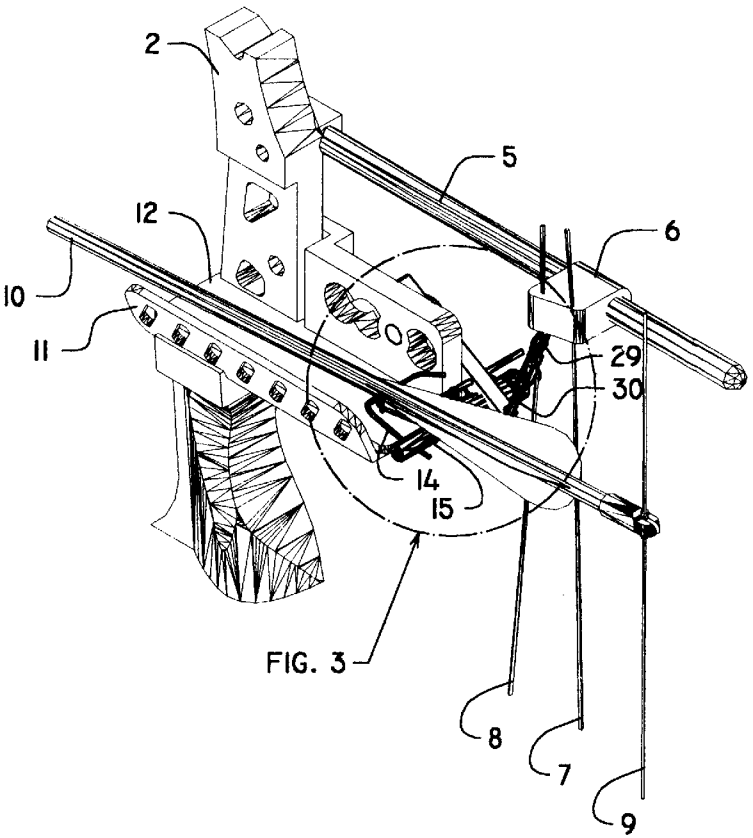
FIG. IA
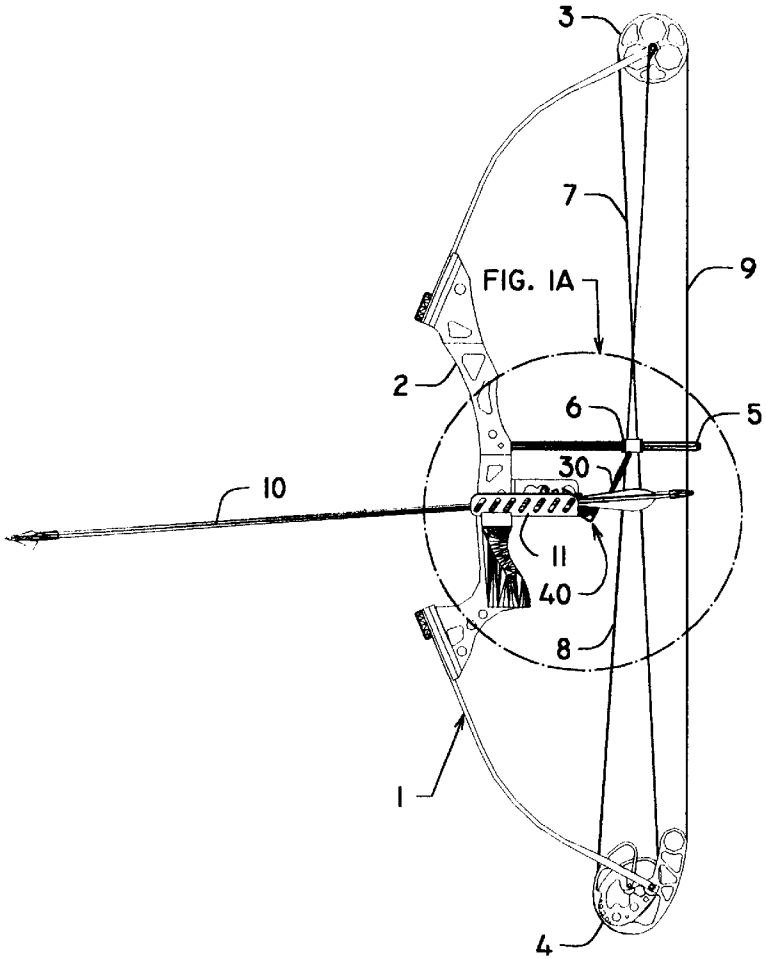
FIG. I

FALL AWAY ARROW REST ASSEMBLY

FIELD OF THE INVENTION

The present invention relates generally to an arrow rest assembly for use with a compound bow, which assembly provides for a more accurate, reliable, and unimpeded discharge of an arrow from such a bow, both in target shooting and in hunting. Furthermore, the inventive assembly is advantageously designed such that the arrow can be held relatively securely in position over the rest while in the nocked mode, thereby limiting the need for additional devices commonly used, especially by hunters, to prevent the arrow from falling off the rest when moving through the field or shooting from an awkward position. The inventive assembly can be mounted directly to a compound bow or to a compound bow having an overdraw assembly, and is operable with both right handed and left handed bows.

BACKGROUND OF THE INVENTION

During the mid 1970s the sport of archery underwent a radical change in equipment design. The traditional archery equipment comprising wooden or laminated wood long bows and recurved bows was gradually replaced by compound bows in essentially all disciplines of the sport. Compound bows, as generally described in U.S. Pat. No. 5,490,492 (Savage), consist of an elongated riser defining a hand grip and supporting a pair of extending flexible limbs on either end. Wheels, cams, or combinations thereof are located at the ends of the limbs. Tuning cables attached to these wheels and/or cams and the bowstring act in concert to produce a much enhanced mechanical advantage when compared to the traditional archery equipment. Moreover, unlike the traditional bow, when the compound bow is drawn, the maximum force required to draw the bow is applied initially, and, as the bow reaches full draw, the force demanded to keep the bow drawn is reduced significantly. This mechanical advantage thus enables the archer to apply less force holding the bow, thereby giving the archer more time and increased steadiness in aiming.

Various types of arrows have been used in both traditional and compound bows. Whereas cedarwood shafts equipped with feather fletchings have been used in the past to assemble arrows, modern arrows are most commonly fabricated of tubular aluminum or carbon fiber shafts equipped with plastic fletchings. Arrow fletchings may be of varying size and are cemented to the shaft of the arrow on a slight angle or may be helixed about the shaft to impart a spin to the shaft, thereby improving the flight characteristics of the arrow. Normally, the fletching comprises three vanes, although fletchings of four and more vanes are available.

In hunting, 3D archery, and field archery, accuracy is of paramount importance. The presence of the arrow rest plays a very significant role in achieving the described accuracy in shooting. There are at least three factors in the operation of a compound bow which may be affected by the presence of the arrow rest. First, the trajectory of the arrow can be altered when the fletching of the arrow contacts the rest. Second, because all arrows are sized to bend slightly under the instantaneous load applied to the shaft upon release, the trajectory of the arrow can be altered by its deflection against the rest. Third, during release of the arrow, the archer may subject the bow to some inadvertent horizontal or vertical movement that is transferred to the rest and thence to the arrow, thereby causing the trajectory of the arrow to be altered.

Accordingly, there has been a great need for an improved arrow rest that virtually eliminates the unpredictable and undesirable deflection of an arrow due to contact with the fletching thereof, or that resulting from bending of the arrow upon loading, or that resulting from an unintentional movement of the archer during shooting.

To counter the problems associated with arrow rest deflection, particularly those resulting from contact with arrow fletchings, various assemblies have been devised, most of which have involved flexible or moveable arrow rests designed to give way from the arrow's path as the fletchings overtake or contact the rest. In addition to U.S. Pat. No. 5,490,492, supra, U.S. Pat. Nos. 3,504,659, 4,071,044, 4,287,868, 4,453,528, 4,658,439, 4,803,971, 5,161,574, 5,365,912, 5,394,858, and 5,415,154 are illustrative of the many proposed solutions to the problem. None of those proposals, however, has found more than minimal acceptance in the archery art because of their unreliable performance and, frequently, because of their complexity of design with multitudinous components.

A device known as an overdraw is frequently attached to a compound bow to allow the use of shorter, stiffer, and lighter arrows which fly faster and farther with a flatter trajectory than a standard arrow. Typically, the overdraw is mounted to the bow by bolting it to the arrow rest mounting hole in the bow riser. The arrow rest bracket is thereafter positioned on the rearward end of the overdraw and the rest then attached to the bracket. The principal purpose of the overdraw is to extend the shelf of the bow riser toward the bowstring, thereby permitting the use of shorter arrows. A secondary feature of the overdraw is the upturned side plate which prevents the arrow from falling off the overdraw shelf prior to and during release of the arrow with possible consequent injury to the archer.

Whereas the overdraw prevents the arrow from falling from the overdraw shelf, it does not prevent the arrow from falling off the arrow rest. If the arrow falls from the arrow rest due to tilting of the bow, which is often the case in bow hunting and 3D archery, the bow must be relaxed, the arrow repositioned, and the bow redrawn. Accordingly, there is the need for an archer, especially when hunting, to have means for keeping the bow and arrow at the ready at all times. That is, the hunter must have means for keeping the fletching end of the arrow nocked against the bow string, and at the same time, have means for holding the head end of the arrow on the arrow rest while pursuing the hunt. Some arrow holding devices are commercially available, but they frequently do not work properly with common spring loaded arrow rests. U.S. Pat. Nos. 4,038,960 and 4,407,261 are illustrative of such arrow lock devices.

Therefore, there has existed a continuing need for an improved arrow rest assembly which provides a relatively secure rest for the arrow shaft, and which spontaneously falls away as the arrow is released from the bow string, thereby resulting in minimal contact between the arrow and the rest as the arrow is launched from the bow.

SUMMARY OF THE INVENTION

Accordingly, the basic purpose of this invention was to devise a precision arrow rest assembly for use on compound bows especially suitable for hunting, 3D, and field archery, which provides for a more accurate and reliable shot of an arrow from such bows.

A special purpose of this invention was to devise such an arrow rest assembly that was of simple design and comprised of a minimal number of moving parts, that simple design, coupled with that minimal number of moving parts, resulting in an arrow rest assembly that is resistant to the effects of inclement weather and is inherently quiet.

A third purpose of this invention was to devise such an arrow rest assembly that is capable of holding a nocked arrow on the rest when the bow is in the relaxed position, but which automatically aligns the arrow immediately prior to the bow reaching the fully drawn position.

Other subsidiary purposes of this invention were to devise such an arrow rest assembly that can be installed on compound bows with cable guide assemblies that are either above or below the hand grip; that can be installed on compound bows with or without an overdraw assembly; and that can be installed on compound bows without modifying or replacing parts conventionally present on compound bows.

The components of the inventive arrow rest assembly and the cooperation of those components are broadly described in the following paragraph:

The inventive device is composed of a static assembly of parts which is rotated about an axis synchronously with the movement of the bow's cabling system as the bow is drawn. As the bow nears the full draw position, an actuator cord attached to the arrow rest assembly and the downward acting cable of the bow becomes taut and begins rotating the arrow holder/guide upward causing the arrow to be moved into firing position. A spring internally mounted within the rest assembly resists this rotational movement, thus forcing the rest to return to its normal downward position following release of the arrow.

Now, defining the components of the arrow rest assembly and the cooperation of those components in more specific terms:

The inventive assembly comprises an arrow rest and a bracket that is mounted to an overdraw or directly to the riser of a compound bow. The arrow rest portion of the assembly is inserted into the bracket, aligned horizontally, and then affixed into place. The arrow rest is internally spring loaded downward. One end of an actuator cord is eccentrically attached to the arrow rest and the other end is attached to the downwardly acting tuning cable of the bow. When the bow string is in the relaxed position, the actuator cord is slack and the arrow holder/guide functions solely to prevent the arrow from falling off the arrow shelf of the overdraw or the riser of the bow. The arrow holder/guide continues to function in this manner until the bowstring is within about 2–4 inches, preferably about 3 inches, of the full draw position.

As the bow is drawn, a cable slide moves along the cable guide bar of the bow causing both the upwardly and downwardly acting tuning cables to move laterally to the rear, and the actuator cord to lose its slack. Upon becoming taut, the actuator cord overcomes the tension in the internally mounted spring and begins rotating the holder/guide of the arrow rest assembly to lift the arrow into a pre-set firing position, while aligning the arrow in the holder/guide. The point at which the actuator cord begins to rotate the arrow rest assembly upward can be varied by lengthening or shortening the actuator cord, and is useful in fine tuning the arrow rest to match the speed of a particular compound bow. For example, a slower compound bow would benefit from a shorter actuator cord, inasmuch as the arrow holder/guide would remain elevated for a longer period of time, thereby permitting the arrow to develop sufficient speed and establish its trajectory prior to losing the support thereof. Conversely, a fast compound bow would benefit from a somewhat longer cord, inasmuch as the trajectory of the arrow would be established quickly and the contact of the holder/guide with the arrow would be minimized, thereby reducing the possibility of the adverse deflection occurrences described above.

When the bowstring is released, the forward lateral movement of the cable slide and the cables on the cable guide, in conjunction with the reverse movement of the formerly downwardly acting tuning cable, allows the actuator cord to go slack. This slackening of the actuator cord permits the internal spring to function, thereby resulting in the rapid downwardly rotation of the holder/guide with consequent loss of contact with the arrow. This downwardly rotation of the arrow rest assembly continues until the pre-set low point is reached, thereby preventing the holder/guide from impacting the arrow shelf of the compound bow riser or the overdraw platform. Because the arrow rest assembly springs away from the arrow shaft upon release from the bow string, the normal bending of the shaft due to instantaneous loading does not impinge upon the rest which causes a rebound effect to thereby alter the trajectory of the arrow. The rest assembly is so designed that precise horizontal and vertical adjustments can be easily accomplished without the loss of spring tension. Likewise, horizontal adjustments can be easily performed without disrupting vertical settings and vice versa.

BRIEF DESCRIPTION OF THE DRAWINGS

The appended drawings depict a modern, high performance compound bow to which an optional overdraw assembly has been installed. The overdraw assembly is an accessory which is conventionally attached to the bow riser by a bolt which is screwed into the threaded arrow rest assembly mounting hole where an arrow rest assembly would normally be fitted to the bow. The arrow rest assembly is subsequently mounted to the overdraw assembly, thereby causing its placement to be rearward of the bow riser. Nevertheless, as noted above, the inventive arrow rest assembly is not required to be mounted to an overdraw assembly, but will function equally well when mounted directly to the bow riser.

The salient features and advantages of the inventive assembly will become more apparent from the following detailed description and accompanying drawings, of which:

FIG. 1 is an elevation view of a compound bow and arrow at rest. The bow is shown fitted with an overdraw assembly to which the inventive arrow rest assembly is mounted. Because the bow is at rest, the arrow rest assembly is depicted in the down or normal position causing the tip end of the arrow to be angled downward.

FIG. 1A is a detailed isometric view of a portion of the compound bow riser showing the inventive arrow rest assembly mounted to the rear of the optional overdraw assembly. As in FIG. 1, the bow is in the relaxed position with the inventive arrow rest assembly at its low set position.

DESCRIPTION OF THE PREFERRED EMBODIMENT

Figure 2A:
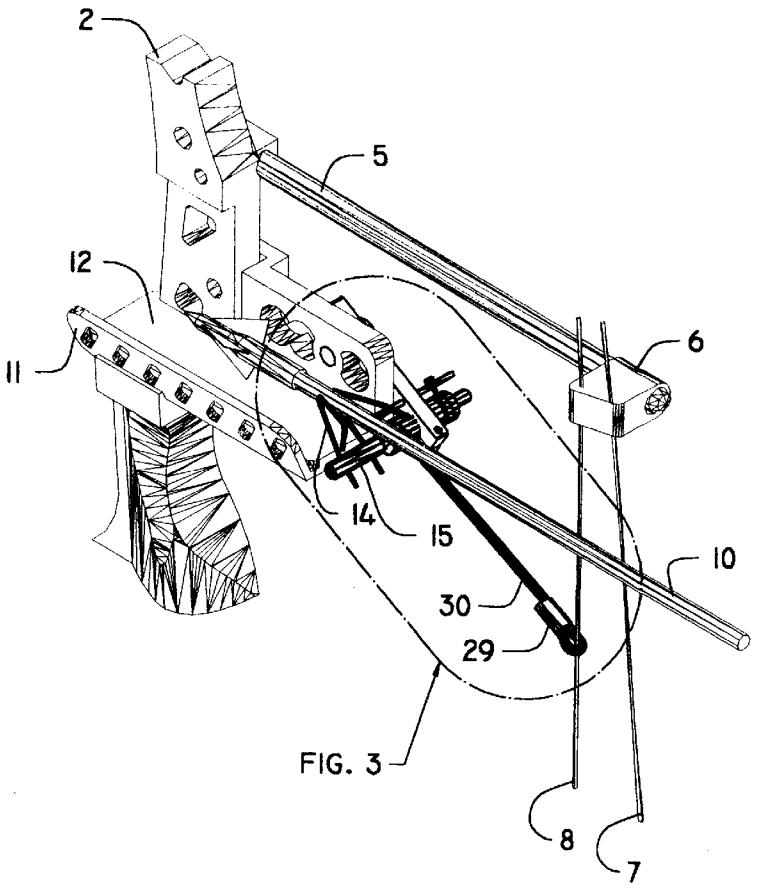
FIG. 2A is a detailed isometric view of a portion of the compound bow riser showing the inventive arrow rest assembly mounted to the rear of the optional overdraw assembly. As in FIG. 2, the bow is in the fully drawn position such that the arrow rest assembly is at its high point position.

FIGS. 1 and 1A depict a compound bow 1 in a state of rest equipped with an overdraw assembly 11 to which the inventive arrow rest assembly 40 is attached at the rear thereof. Compound bow 1 is comprised of a riser 2, an idler wheel 3, a compound cam 4, a cable guide 5, a cable slide 6, an upwardly acting tuning cable 7, a downwardly acting tuning cable 8, a bowstring 9, and an arrow 10. An adhesive-backed cushion 12 is attached to the top surface of the overdraw assembly platform to silence the apparatus when the arrow is in contact with the overdraw assembly.

Figure 2:
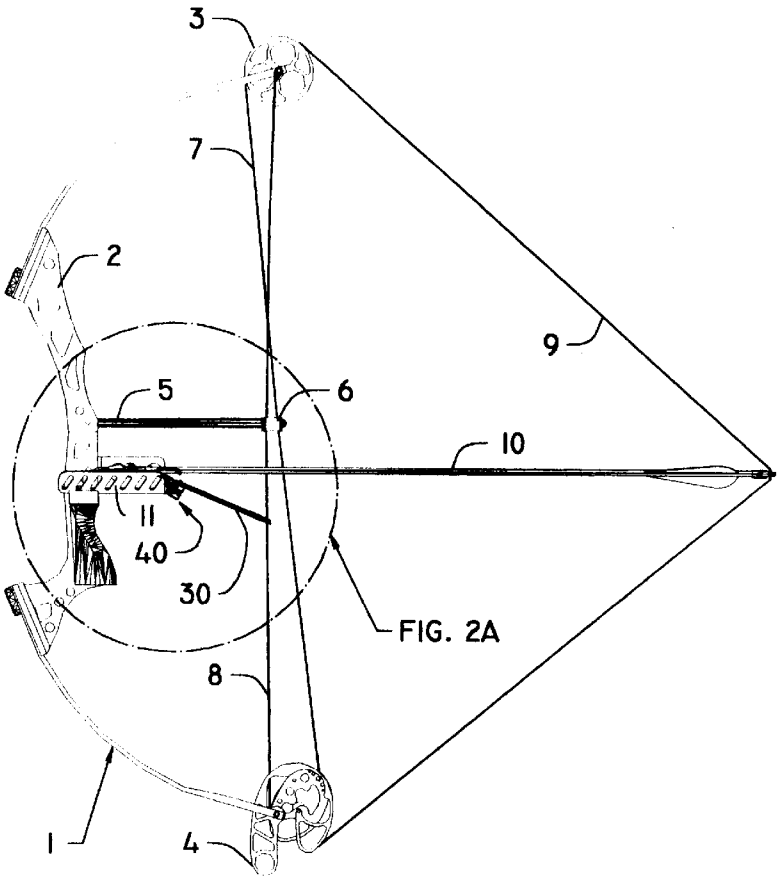
FIG. 2 is an elevation view of a compound bow with the arrow in the fully drawn position. The bow is depicted fitted with an overdraw assembly to which the inventive arrow rest assembly is mounted. Inasmuch as the bow is fully drawn, the arrow rest assembly is pictured in the up or high set point position, such that the tip end of the arrow is properly elevated and aligned prior to release of the arrow.

FIGS. 2 and 2A depict the compound bow apparatus of FIGS. 1 and 1A, but wherein the bow is in the energized state.

Figure 3:
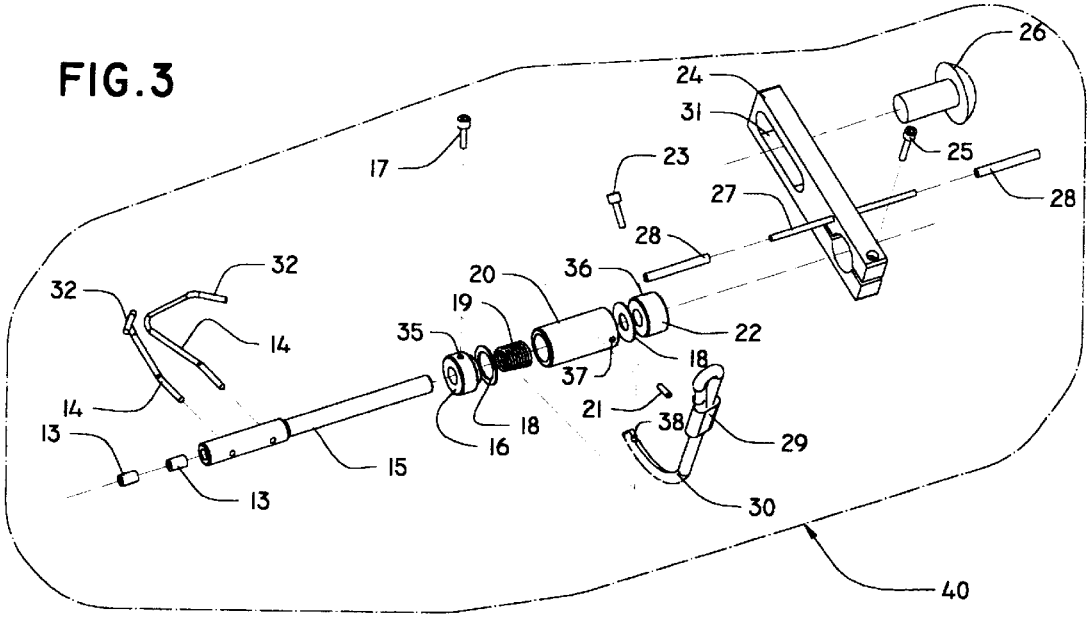
FIG. 3 is an exploded isometric view of the inventive arrow rest assembly exclusive of the overdraw assembly and compound bow riser.

FIG. 3 is an exploded isometric view of inventive arrow rest assembly 40 and illustrates that it is composed of an arrow rest subassembly and a bracket subassembly for attachment to overdraw assembly 11 or bow riser 2.

The bracket subassembly comprises a bracket 24 into which a high/low stop point pin 27 is mounted, which pin is covered with heat shrink tubing 28 to silence it. Screw 25 supplies the means for clamping the arrow rest subassembly to bracket 24 and permits horizontal adjustments to be made when tuning bow 1. Bolt 26 joins bracket 24 to the overdraw assembly 11 through slot 31 in bracket 24. Slot 31 permits adjustments in the position of bracket 24 on the overdraw assembly 11.

Figure 5:
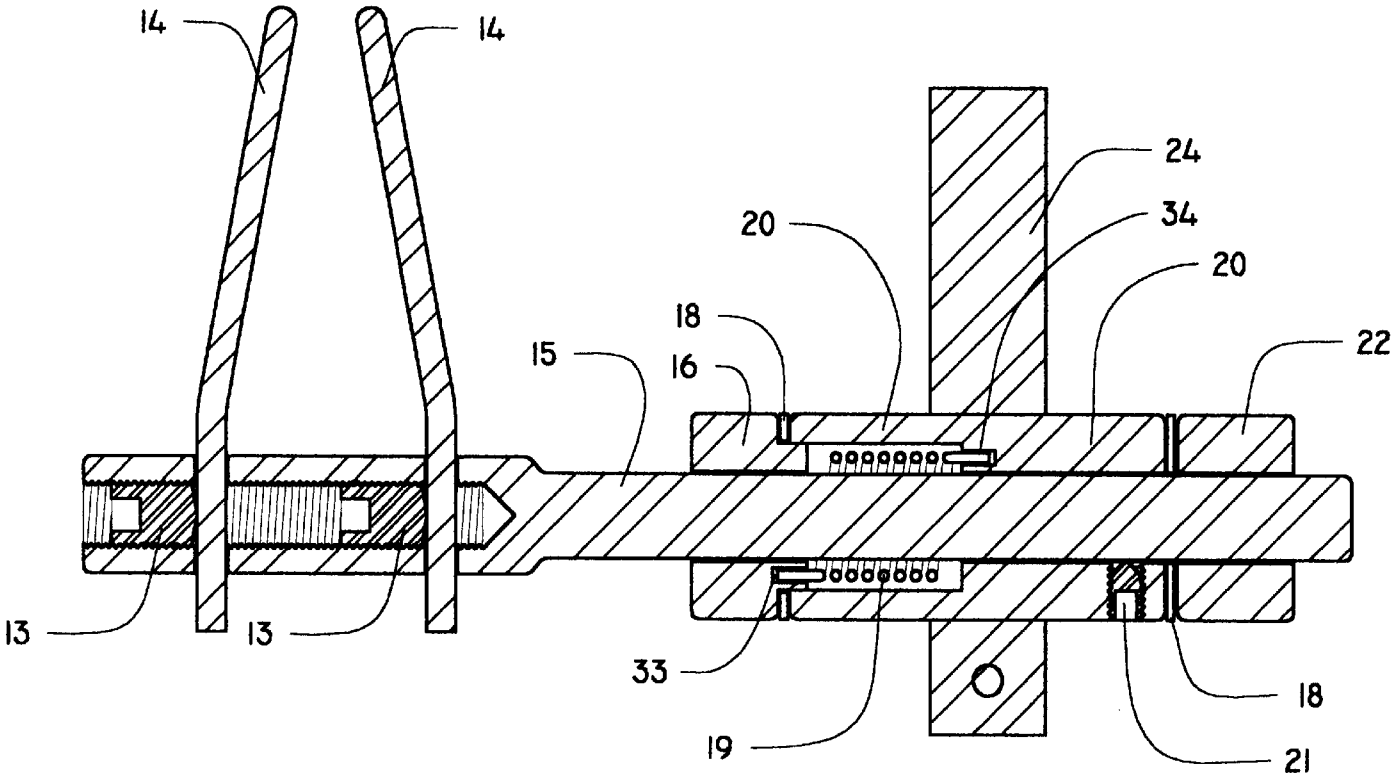
FIG. 5 comprises a horizontal section cut through the center line of axle rod 15 depicted in FIG. 3.

The inventive arrow rest subassembly consists of a truncated, forked-shaped arrow holder/guide 14 comprised of a pair of prongs which are inserted into cylindrical axle rod 15 and individually secured therein by set screws 13. As illustrated in FIG. 3, the tabs 32 of arrow holder/guide 14 are bent backward at an angle with the tips thereof tapered outwardly. Where greater security of the arrow from falling off the inventive rest is desired, however, tabs 32 may have no taper or may be tapered inwardly. In general, the angle at which tabs 32 are bent backwards ranges about 30°–60°, with about 45° being preferred. As depicted in FIG. 5, axle rod 15 comprises a metal bar into which a hole is drilled and threaded to provide for set screws 13. Abaft of holder/guide 14, axle rod 15 is optionally machined to a somewhat smaller diameter to minimize size and weight. Collar 16 is shouldered to accept TEFLON® washer 18 and fitted onto axle rod 15. As is illustrated in FIG. 5, collar 16 has a small hole 33 into which one end of stainless steel spring 19 is inserted. Bushing/housing 20 also has a similar small hole 34 into which the opposite end of spring 19 is inserted. Washer 18, collar 22, and bushing/housing 20 are also fitted on axle rod 15. An actuator cord 30 is looped around downwardly acting tuning cable 8 and secured loosely thereto by sleeve 29. Thereafter, low point setscrew 17 is passed through hole 38 in the free end of actuator cord 30 and into a threaded hole 35 in the side of shouldered collar 16, thereby locking it to axle rod 15. Cord 30 may consist of any strong, relatively inelastic material which is sufficiently flexible to be run from screw 17 and looped around tuning cable 8. I have found a NYLON® cord of about 0.125" diameter to be especially effective. A cord prepared of a highly elastic material such as rubber, has not been found to function well because of its counteraction to the spring. The high point setscrew 23 passes through a threaded hole 36 in collar 22 to lock it onto axle rod 15. When assembled, bushing/housing 20 is rotated about axle rod 15 to compress spring 19. Then setscrew 21 is passed through a threaded hole 37 in bushing/housing 20 to lock it to axle rod 15, resulting in spring 19 remaining in the energized state.

After placing the inventive arrow rest subassembly into the bracket subassembly, the actuating positioning of the arrow rest subassembly is adjusted by first rotating the rest until the holder/guide 14 just touches the adhesive-backed cushion 12. The low point is then set by adjusting low point setscrew 17 to touch heat shrink tubing 28 on high/low stop pin 27. Thereafter, the arrow rest subassembly is adjusted horizontally and locked into position by setscrew 25. Unscrewing setscrew 21 releases the energy of spring 19 thereby causing setscrew 17 to be forced tightly against heat shrink tubing 28. The high point is set by rotating the now energized arrow rest subassembly upwardly to the desired height and locking setscrew 23 into collar 22 and to axle rod 15, so that it is in contact with heat shrink tubing 28 on high/low stop pin 27. Finally, the timing of the arrow rest subassembly is set by adjusting loop end sleeve 29 of actuator cord 30 around tuning cable 8 and locking setscrew 21 so that the rest is at its high point setting, and, thereafter, drawing bow 1 until it is about 2–4 inches, preferably about 3 inches, short of full draw. When that draw is reached, actuator cord 30 is adjusted at loop and sleeve 29 so that it is taut enough to overcome the tension in spring 19 and to stop cable slide 6 just short of its full travel. Bow 1 is then relaxed and sleeve 29 of actuator cord 30 is firmly affixed to downwardly acting tuning cable 8 to permanently set its proper length.

Fine tuning the inventive arrow rest subassembly is performed by locking setscrew 21 to axle rod 15 to prevent loss of tension in spring 19. With setscrew 21 locked, setscrew 25 can be loosened to permit fine horizontal adjustments. Inasmuch as setscrew 17 will ride along heat shrink tubing 28 on high/low point stop pin 27, there will be no loss of vertical adjustment. Conversely, vertical adjustments can be achieved by loosening setscrews 17 and 23 and adjusting the rotations of collars 16 and 22 to fine tune either the high point or low point of holder/guide 14. Such vertical adjustments are carried out with spring 19 under tension and the arrow rest subassembly affixed in the bracket subassembly by setscrew 25.

Figure 4A:
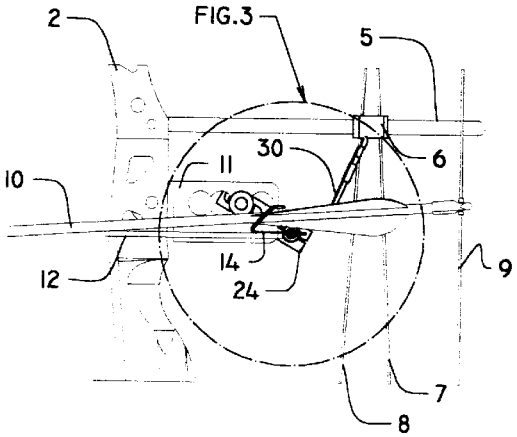
FIG. 4A is an elevation view of a portion of the bow riser, overdraw assembly, and inventive arrow rest assembly in the normal or low set position, but for purposes of clarity, the side and platform of the overdraw assembly have been omitted. As in FIGS. 1 and 1A, the bow and arrow are in the relaxed position and the inventive arrow rest assembly is at its normal or low set point position.
Figure 4B:
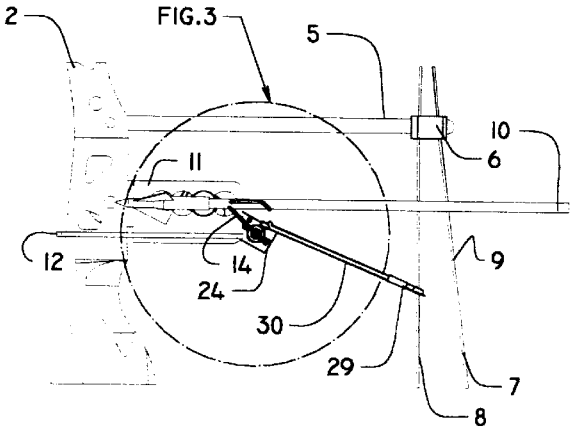
FIG. 4B is an elevation view of a portion of the bow riser, overdraw assembly, and inventive arrow rest assembly in the up or high set point, but, for purposes of clarity, the side and platform of the overdraw assembly have been omitted. As in FIGS. 2 and 2A, the bow and arrow are in firing position and the inventive arrow rest assembly is at its high set point.

To describe the operation of a compound bow equipped with the inventive arrow rest assembly in the simplest terms:

As compound bow 1 is drawn, arrow 10 remains in the down position throughout all but the last few inches of its travel. Bow 1 does not need to be held at a level state in order to keep arrow 10 from falling out of holder/guide 14. Moreover, arrow 10 need not be exactly centered in holder/guide 14 inasmuch as the latter will automatically center arrow 10 due to its "vee" shape when inventive arrow rest assembly 40 begins to rise. As observed above, when bow 1 is within about 2–4 inches of full draw, actuator cord 30 becomes taut to overcome the tension in spring 19 and begins to rotate axle rod 15, thereby causing holder/guide 14 to rotate upwardly. As holder/guide 14 rotates upwardly, arrow 10 is automatically centered in the "vee" thereof. As illustrated in FIGS. 2, 2A, and 4B, at full draw arrow 10 is in the up position and arrow rest assembly 40 is at its high set point. At that time tabs 32 of holder/guide 14 are in a generally horizontal position and arrow 10 is ready to be released.

Upon release of arrow 10, the motion of arrow holder/guide 14 is essentially reversed, allowing arrow 10 to slide along holder/guide 14 for a very short distance (about 2–4 inches) before spring 19 causes holder/guide 14 to fall quickly and completely away from arrow 10. In so doing, arrow 10 is momentarily supported by holder/guide 14 to assure a true flight, but the trajectory of arrow 10 is not disrupted by holder/guide 14 coming into contact with the fletching of arrow 10 or by inadvertent movement by the archer being transferred to arrow 10 through arrow rest assembly 40.

I claim:

1. An arrow rest assembly for use with a compound bow, said bow comprising a frame, optionally equipped with an overdraw assembly, having a cable guide bar extending therefrom, a bow string having an upwardly acting tuning cable and a downwardly acting tuning cable which are attached to a cable slide slidably mounted on said cable guide bar, said assembly comprising:

(a) a bracket subassembly mounted on said bow frame or on said optionally equipped overdraw assembly;

(b) an arrow rest subassembly rotatable about an axis synchronously with the movement of said tuning cables as said bow is drawn and released which contains an internally mounted spring and carries an arrow holder/guide, said subassembly being pivotally mounted to said bracket subassembly; and (c) an actuator cord prepared from a strong, flexible, but relatively inelastic, material attached to said arrow rest subassembly and said downwardly acting tuning cable which, when said bowstring is drawn in a direction away from said frame to within about 24 inches of full draw position, becomes taut and, overcoming the tension in said spring, rotates said holder/guide of said arrow rest subassembly upward to lift and align an arrow in firing position, and which, when said bowstring is released, becomes slack, thereby allowing said arrow to slide along said holder/guide for about 2–4 inches before allowing the tension in said spring to function causing said holder/guide of said arrow rest subassembly to rapidly fall away from contact with said arrow.

2. An arrow rest assembly according to claim 1 wherein said holder/guide has a truncated, fork-shaped structure comprised of a pair of prongs having end tabs that are bent backwards at an angle.

3. An arrow rest assembly according to claim 2 wherein said end tabs are bent backward at an angle between about 30°–60°.

* * * * *

UNITED STATES PATENT AND TRADEMARK OFFICE

CERTIFICATE OF CORRECTION

PATENT NO. : 6,044,832
APPLICATION NO. : 09/131516
DATED : April 4, 2000
INVENTOR(S) : Donald W. Piersons, Jr.

It is certified that error appears in the above-identified patent and that said Letters Patent is hereby corrected as shown below:

Column 8, Line 10: replace the number“24” with the phrase --2-4--

Signed and Sealed this

Ninth Day of January, 2007

JON W. DUDAS
*Director of the United States Patent and Trademark Office*